US005741023A

United States Patent [19]

Schiele et al.

[11] Patent Number: 5,741,023

[45] Date of Patent: Apr. 21, 1998

[54] BINDING FOR TOURING SKI AND SNOWBOARD

[75] Inventors: Stefan Schiele, Forstinning; Norbert Eugler, Karlsfeld, both of Germany

[73] Assignee: silvretta-sherpas Sportartikel GmbH, Karlsfeld, Germany

[21] Appl. No.: 389,873

[22] Filed: Feb. 17, 1995

[30] Foreign Application Priority Data

Feb. 17, 1994 [DE] Germany ..... 44 05 097.6

[51] Int. Cl.[6] ..... A63C 9/00

[52] U.S. Cl. ..... 280/607; 280/615; 280/142; 280/618

[58] Field of Search ..... 280/607, 614, 280/615, 617, 618, 14.2

[56] References Cited

U.S. PATENT DOCUMENTS

| | | | |
|---|---|---|---|
| 3,908,971 | 9/1975 | Engel | 280/614 |
| 4,674,766 | 6/1987 | Ramer | 280/614 |
| 4,718,694 | 1/1988 | Brice et al. | 280/614 |
| 5,318,320 | 6/1994 | Ramer | 280/614 |

FOREIGN PATENT DOCUMENTS

| | | |
|---|---|---|
| 0 362 782 | 4/1990 | European Pat. Off. . |
| 28 48 664 | 5/1979 | Germany . |
| 8903154 U | 8/1989 | Germany . |
| 9108618 U | 1/1992 | Germany . |

*Primary Examiner*—Richard M. Camby

*Attorney, Agent, or Firm*—McAulay Fisher Nissen Goldberg & Kiel, LLP

[57] ABSTRACT

The binding, which is suitable for touring skis as well as snowboards, is constructed in two parts and includes a base part which is shorter than the conventional touring binding and is mounted on a narrow snowboard by means of a fastening part without projecting over the lateral edges of the snowboard. As a result of the decreased length, the clamped in boot projects beyond the base part. A fastening part formed by a bearing part and a lengthening piece is arranged in a stationary manner with respect to the ski so that this base part can also be used as a touring binding. The lengthening piece is supported at the bearing part in a swivelable manner. This lengthening piece can be inserted into and secured within an insert enclosure constructed at the base part.

11 Claims, 9 Drawing Sheets

Fig. 4
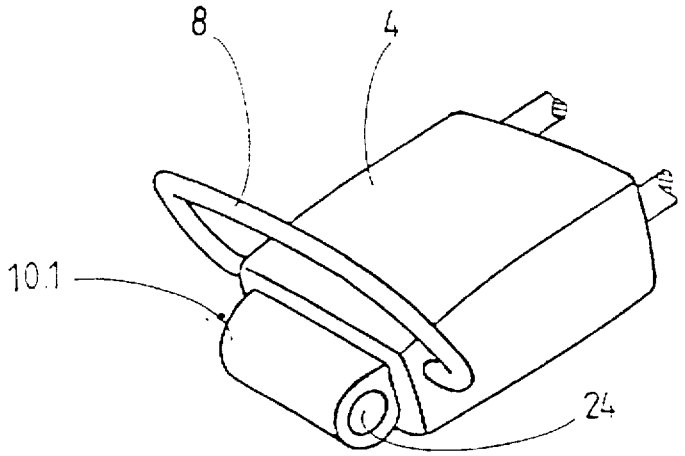
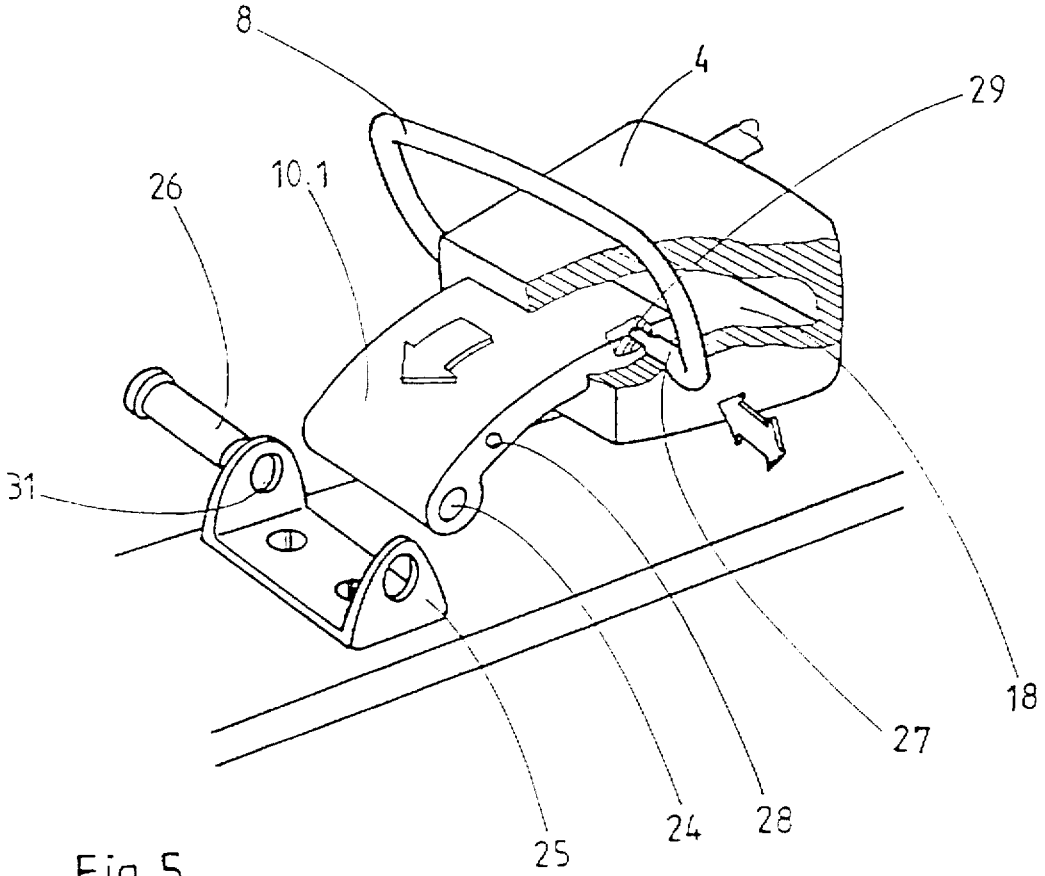
Fig. 5

BINDING FOR TOURING SKI AND SNOWBOARD

BACKGROUND OF THE INVENTION a) Field of the Invention

The invention is directed to a binding for a touring ski and a snowboard.

b) Description of the Related Art

It is known to connect commercially available skis by means of hardware fittings to form a snowboard so that terrain in which there are no lift facilities available may be ascended with the skis. For downhill travel, the skis are then joined to form a snowboard. In so doing, it is necessary to secure the bindings to the skis and to the snowboard by means of detachable hardware fittings such that the bindings may be converted. The snowboard is provided with a different binding arrangement extending substantially transversely to the longitudinal axis of the snowboard.

In a cross-country or touring binding which is mounted transversely on the assembled snowboard, a problem occurs in that the touring binding projects out laterally over the snowboard and hampers turning.

OBJECT AND SUMMARY OF THE INVENTION

The object of the present invention is to provide a binding for touring skis and snowboards which satisfies the requirements typically imposed on this binding for its respective kind of application.

This object is met, according to the invention, in that the binding has a twofold construction having a base part with holders for the boot, which base part can be employed for both kinds of application, and two different fastening parts which are adapted to the respective type of use and are arranged in a stationary manner on the touring ski or snowboard and can be connected with the base part so as to be detachable, in that the length of the base part allows this base part to be arranged on a snowboard without projecting beyond the snowboard, and in that the fastening part arranged on the touring ski has an extension piece or lengthening piece which is supported in an articulated manner at a bearing part transversely to the longitudinal direction of the skis and forms a swivelable touring binding in combination with the base part. Since the base part has the holders for the boot, it forms a snowboard binding when combined with the fastening part associated with the snowboard.

Since the length of the base part allows it to be arranged on a snowboard without overlapping the snowboard and accordingly allows the base part to be mounted transversely on the snowboard, i.e., since it is sufficiently short so that it does not project beyond the snowboard in either the front or rear area, this base part is, by itself, too short to function as a touring binding for the touring ski. Because of the design of the base part according to the invention, the length of this base part allows the boot to be fastened to the base part by means of holders, but the toe region of the boot projects beyond the base part as a consequence of the potential use of the base part as a snowboard binding. In order to use the base part by itself as a touring binding, a swivel axis or swivel pin arranged at the front end of the base part would lie behind the toe region so that the binding would have to be supported extremely high above the skis to enable a swiveling of the boot due to the projecting tip of the boot. This would considerably increase the danger of tipping and overturning. The twofold construction according to the invention makes it possible to ensure the necessary length of the touring binding in that the fastening part arranged on the touring ski includes a lengthening piece which is supported in an articulated manner at a bearing part transversely to the longitudinal direction of the ski and can be connected with the base part so as to form a touring binding in which the swivel axis lies at the toe of the boot. Accordingly, the boot can swivel together with the touring binding about a swivel axis having only a very slight vertical distance from the surface of the ski so that the aforementioned risk of tilting and tipping over is prevented. Since the base part is shorter than the boot and can be secured in its own right on the snowboard in connection with the fastening part, a snowboard binding is provided which does not project out over the snowboard and accordingly enables trouble-free snowboarding. Thus, the invention provides a binding which satisfies the typical requirements for a touring binding as well as those for a snowboard binding.

Various possibilities for constructing the fastening part associated with the touring skis are described in the following.

A first advantageous construction consists in that an insert enclosure is constructed at the front end of the base part to receive the lengthening piece in a positive engagement and in that fastening means are provided in the insert enclosure for securing the lengthening piece. Such an insert enclosure can be provided in a base frame as well as in a base plate. In particular as regards so-called soft bindings for snowboards, this latter possibility makes it possible for the first time to use these bindings for touring as well. Soft bindings of this kind have a base plate and shell-shaped holders connected with the latter which partially enclose the boot and are provided with belts and buckles for holding a typical snowboard boot. According to the invention, a suitable insert enclosure for a lengthening piece is provided in the base plate in this binding so that a binding of this type, which was previously used only for snowboards, is supported in a swivelable manner so that it can be used as a touring binding on a touring ski.

In a further development of the invention, the free end of the lengthening piece associated with the insert enclosure is slit in the longitudinal direction and has a conical recess in the slit region for a fastening screw having a centering cone which engages in the conical recess of the lengthening piece and this fastening screw can be screwed into the insert enclosure so as to extend through the lengthening piece. Accordingly, it is possible to expand or spread the lengthening piece somewhat by means of the centering cone of the fastening screw, since the slot extends beyond the conical recess, so that the lengthening piece is firmly wedged in the insert enclosure. This results in an extremely stable connection between the base part and lengthening piece so that the touring binding so formed can be swivelably supported on the ski without lateral play in the same way as previous touring bindings. Since the operation by which the bindings are changed from the touring ski to the snowboard formed by the skis is performed in open country and since it is burdensome to carry tools along, it is provided in a further construction of the invention that the centering cone has a fold-up handle on its upper surface for operating the fastening screw.

Another possible construction according to the invention consists in that the lengthening piece is held in the insert enclosure so as to be displaceable and can be secured in a pushed in end position as well as in a pulled out end position which lengthens the base part to form a touring binding, and in that the end of the lengthening piece projecting out of the insert enclosure has a transversely extending bearing bore hole so that it can be swivelably mounted in a detachable manner on a bearing part arranged on the ski. In this embodiment form, in contrast to the construction described above, the lengthening piece can remain not only on the bearing part, but also in the base part and can be optionally pushed in for mounting on the snowboard or pulled out farther for mounting on the touring ski so as to create a touring binding of sufficient length. A relatively long guide path can be provided for the lengthening piece in such a construction so as to enable a good positively engaging support in the insert enclosure without the need of fastening screws with clamping action. In so doing, the lengthening piece can be secured by means of a toe stirrup which is supported in a swivelable manner at a front sole support having the insert enclosure and can be locked into bore holes in the lengthening piece in a springing manner by its ends which project into the insert enclosure and serve as bearing necks for the toe stirrup. Such toe stirrups are known generally for touring bindings and may, in themselves, be constructed resiliently so that the lengthening piece can be converted within the insert enclosure simply by spreading the toe stirrup somewhat so as to free the bearing necks of the toe stirrup from the corresponding bore holes of the lengthening piece so that this lengthening piece can be displaced and brought into the new position in which it is secured in that the bearing necks spring back again.

According to a first embodiment form, the base part can have a base frame with two parallel legs which are connected with one another in the front region and rear region by a sole support in each instance, the holders for the boot being arranged at the latter, the front sole support having the insert enclosure for receiving the lengthening piece in a positive engagement. A base part designed in this way is employed in particular when using a standard sturdy ski boot or mountaineering boot.

On the other hand, if a conventional soft snowboard boot is used, it is advantageous to provide another embodiment form of the binding in which the base part has a base plate with holders, the base plate has a recess and two legs which are arranged at a distance from one another and penetrate the recess in the longitudinal direction of the sole, and the insert enclosure for receiving the lengthening piece in a positive engagement is constructed at the front end of the base plate. In its basic design with respect to the holders for the boot, such a binding is known as a soft snowboard binding and conventionally has a rigid shell part with straps in the heel region and ankle region for holding a soft snowboard boot.

In another construction, the binding can be used on a touring ski or as a downhill binding in that a dovetail-shaped recess is provided at the underside of the base part in the rear region of the base plate and cooperates in a positive locking manner with a correspondingly adapted rail extending in the longitudinal direction of the ski so as to be stationary with respect to the ski in order to lock the base plate in the downhill travel position.

According to an advantageous construction of the invention, the fastening part associated with the snowboard can have a holder part with receptacles constructed at two opposite sides of the holder part for receiving the legs of the base part. One receptacle is as a groove-shaped notch defined by a lower flange and an upper flange and the opposite receptacle is open toward the top and is defined only by a lower flange. Further, a closing flap can be supported at the lower flange of the receptacle, which is open at the top, in such a way that this closing flap is swivelable about a swivel pin provided parallel to the longitudinal axis of the receptacle and can snap in under the upper flange of the receptacle with a shoulder constructed at the free lateral edge of the closing flap.

In another development of the invention, the upper flange can have a bevel which tapers outward at the upper side of its free edge so as to make this snap-in locking easier and to facilitate the required deformation in the closing flap.

Every receptacle can advantageously have a locking peg which is disposed at right angles to the longitudinal axis of the receptacle and engages in a corresponding recess of the respective leg of the base part in the assembled position of the binding so that the legs belonging to the base part are held in the receptacles in a positive engagement, i.e., so as to be fixed with respect to displacement.

The invention will be explained more fully in the following with reference to various embodiment examples shown in the drawing.

BRIEF DESCRIPTION OF THE DRAWINGS

FIGS. 4 and 5 show the front part of a binding with another embodiment example of a lengthening piece in different installation positions as a snowboard binding and as a touring binding, respectively;

DESCRIPTION OF THE PREFERRED EMBODIMENTS

Figure 1:
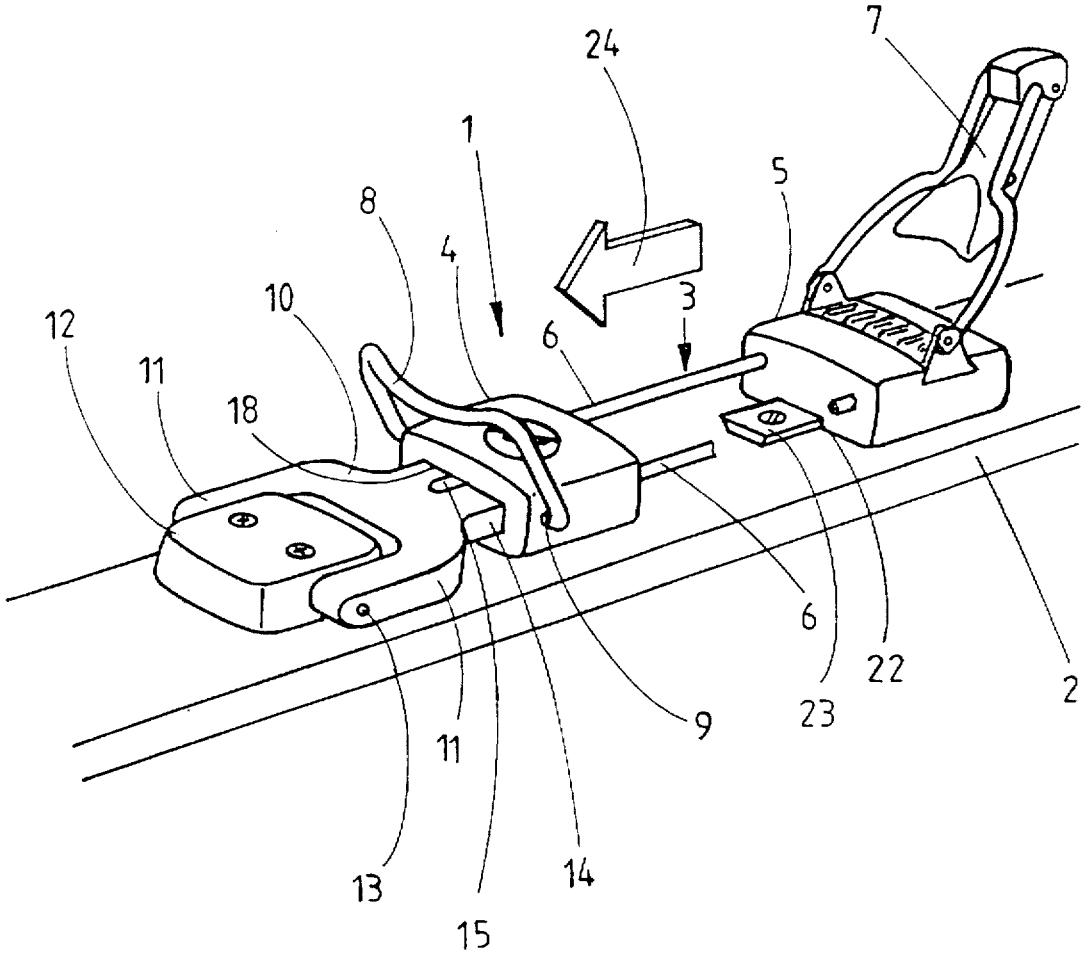
FIG. 1 shows a combination binding for a touring ski and snowboard on a ski in the downhill travel position.

FIG. 1 shows a binding, designated in its entirety by 1, on a ski in the downhill travel position. This binding is constructed in two parts and includes a base part 3, which can be used for ski touring as well as for a snowboard, and a fastening part 10, 12. In the embodiment example shown in the drawing, the base part 3 is constructed as a base frame with a front sole support 4, a rear sole support 5 and legs 6 connecting these two parts. A heel tightener 7 of conventional construction is swivelably supported at the rear sole support serving as a heel support 5, while an insert enclosure 18 is constructed at the front sole support 4 to receive a lengthening piece 10 in a positive engagement. The lengthening piece 10 is supported by means of two fork-like legs 11 formed thereon so as to swivel about an axis extending transversely to the longitudinal direction of the ski on a bearing part 12 which is stationary with respect to the ski. A conventional toe stirrup 8 is also arranged at the front sole support 4 and is supported in a swivelable manner by its inwardly bent ends which serve as bearing necks 9.

The base part of the binding, which base part is designated in its entirety by 3, is shorter than a conventional touring binding, so that the tip of the boot which is clamped between the toe stirrup 8 and heel tightener 7 projects over the front end, i.e., over the front sole support 4. This shorter length is required so that the base part 3, when used with a fastening part of different design, can be mounted on the snowboard substantially in the transverse direction so that this base part 3 does not project over the snowboard. Thus, the length of the base part 3 is adapted so as to allow a boot to be received and held without projecting out over the snowboard in the assembled state.

Figure 3:
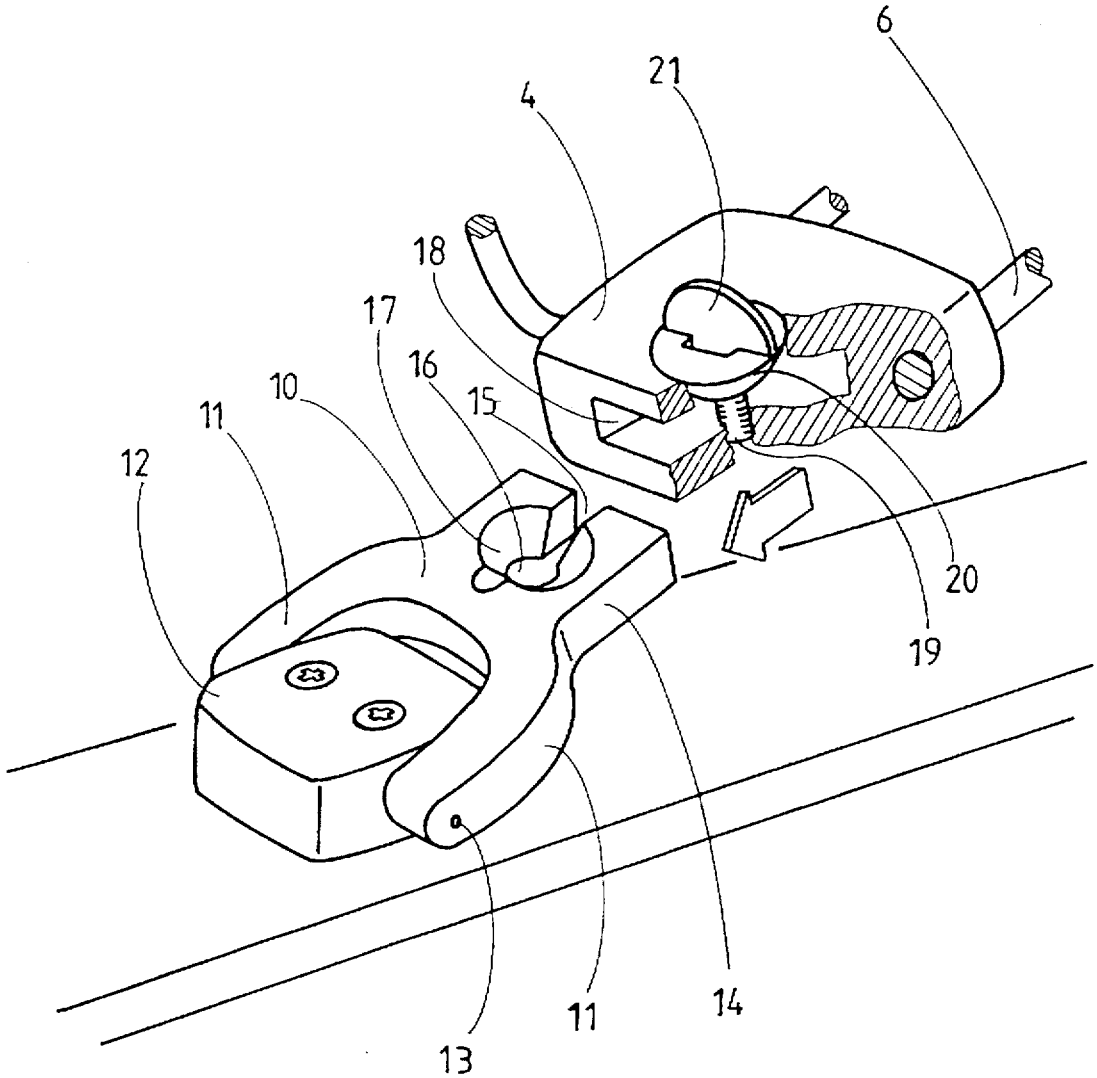
FIG. 3 shows a detailed view of a lengthening piece prior to insertion into the binding.

In order to use the base part 3 as a touring binding on a touring ski, this base part 3 is combined with the fastening part formed by the lengthening piece 10 and bearing part 12. For this purpose, the lengthening piece 10 is pushed into the insert enclosure 18. At the end located opposite the swivel pin 13, the lengthening piece 10 has a tongue 14, as will be seen in particular from FIG. 3, this tongue 14 being provided with a central longitudinal slot 15 and a bore hole 16 which is constructed in the region of the longitudinal slot 15 and is provided with a recess 17 which widens conically in an upward direction. The longitudinal slot 15 extends beyond this recess 17. The tongue 14 is intended for insertion into the enclosure 18 which is constructed as an adapted insert opening so that the tongue 14 can be received in the insert enclosure 18 with a fairly exact fit. A fastening screw 19 which penetrates the insert enclosure and has a centering cone 20 and a fold-up handle 21 on its upper surface is provided for securing the lengthening piece 10. By means of the centering cone 20 which engages in the conical recess 17, the tongue 14 can be spread apart somewhat due to the arrangement of the slot 15 so that it can be securely clamped within the insert enclosure 18 by means of the fastening screw 19 resulting in an extraordinarily secure fit of the lengthening piece 10 in the insert enclosure 4.

Figure 2:
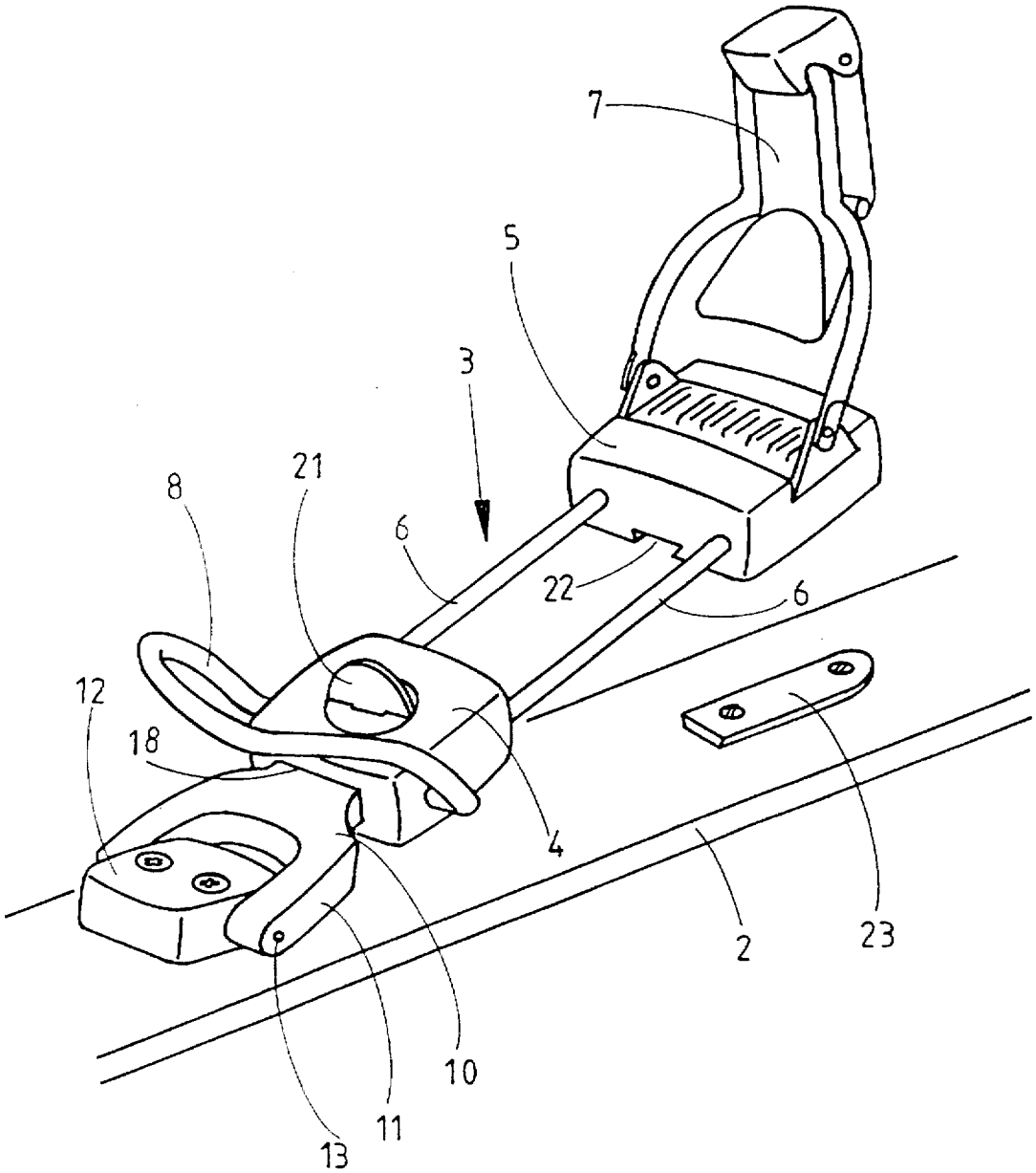
FIG. 2 shows this binding on a ski in the touring position.

In FIG. 1, the binding which is designed as a touring binding and mounted on a ski 2 is shown in the downhill travel position. For this purpose, the heel support 5 is provided with a dovetail-shaped recess 22, by means of which the heel support 5 can slide on a suitably constructed rail 23 in the direction indicated by arrow 24, this rail 23 being secured in the longitudinal direction. FIG. 2 shows the corresponding touring position in which the heel support 5 can be lifted and the base part 3 can swivel upward about the swivel pin 13.

FIGS. 4 and 5 show another construction of the lengthening piece which, in this embodiment example, is constructed in its entirety as an elongated tongue 10.1. This lengthening piece 10.1 can be secured within the insert enclosure 18 in two positions. The end of the lengthening piece 10.1 projecting out of the insert enclosure 18 is provided with a transversely extending bearing bore hole 24 which serves to support the lengthening piece 10.1, and accordingly the entire binding, in a swivelable manner at a bearing part 25 which is stationary with respect to the ski. An insertable bearing pin 26 is provided for the purpose of fastening the lengthening piece 10.1 in a detachable manner at the bearing part 25 which is fixed with respect to the ski.

The inwardly bent ends of the toe stirrup 18 which engage in the interior of the insert enclosure 18 and, depending on the insertion depth, cooperate with bore holes 28 and 29 in the lengthening piece 10.1 serve to fasten the lengthening piece 10.1 in the insert enclosure 18. In the inserted position shown in FIG. 4, in which only the bearing bore hole 24 projects from the insert enclosure 4, the bearing necks 27 engage in the bore holes 28 of the lengthening piece 10.1. In this position, the base part 3 is suitable for mounting on a snowboard. FIG. 5 shows the pulled out position of the lengthening piece 10.1. In this case, the bearing necks 27 of toe stirrup 8 engage in bore holes 29 of lengthening piece 10.1. In this position, the lengthening piece adds to the short length of the base part 3 and renders it suitable for touring. In so doing, the front end of the lengthening piece 10.1 is secured at the bearing part 25 by means of bearing pin 26.

Figure 6:
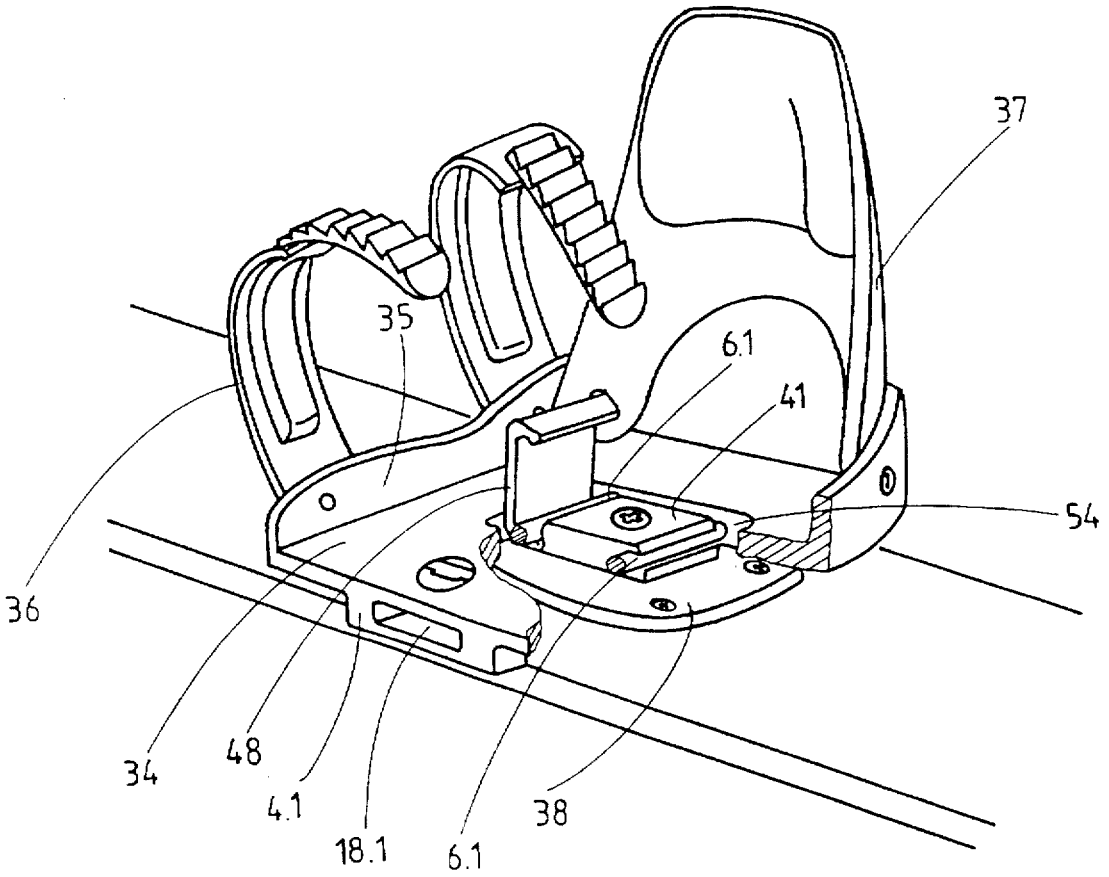
FIG. 6 shows a soft snowboard binding on a snowboard.
Figure 7:
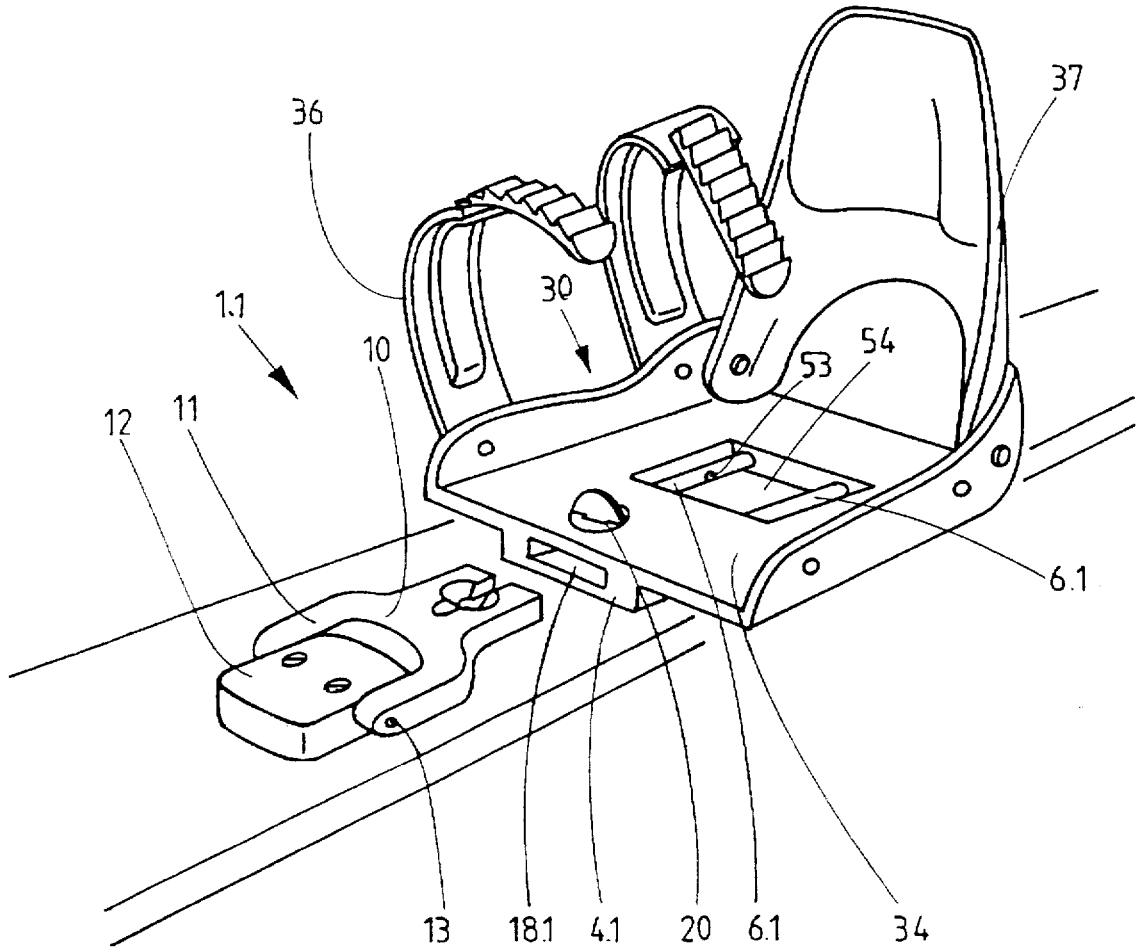
FIG. 7 shows the binding according to FIG. 6 in connection with a lengthening piece as a touring binding.

FIGS. 6 and 7 show a so-called soft binding for snowboards which is also suitable, according to the invention, for use on touring skis. FIG. 6 shows the binding used on a snowboard, while FIG. 7 shows the binding as a touring binding on a touring ski. This binding has a base part 30 which includes a base plate 34 with a raised edge 35 for fastening retaining straps 36 having corresponding buckles on the opposite side, not shown, and a support shell 37 for the heel area of the boot. An insert enclosure 18.1 with a corresponding opening 31 is provided in the front region of the base plate 34. The lengthening piece 10 described with reference to FIGS. 1 to 3 can be inserted into this opening and secured by means of the fastening screw and its centering cone 20 in the same manner as described with reference to FIGS. 1 to 3. Therefore, this lengthening piece and its fastening need not be discussed at greater length. FIG. 7 shows the lengthening piece 10, which is supported so as to be swivelable on the ski, immediately before being inserted into the insert enclosure 18.1 of the binding, designated in its entirety by 1.1, so that this binding makes it possible to climb by means of the skis after the lengthening piece 10 is secured on a touring ski.

Figure 8:
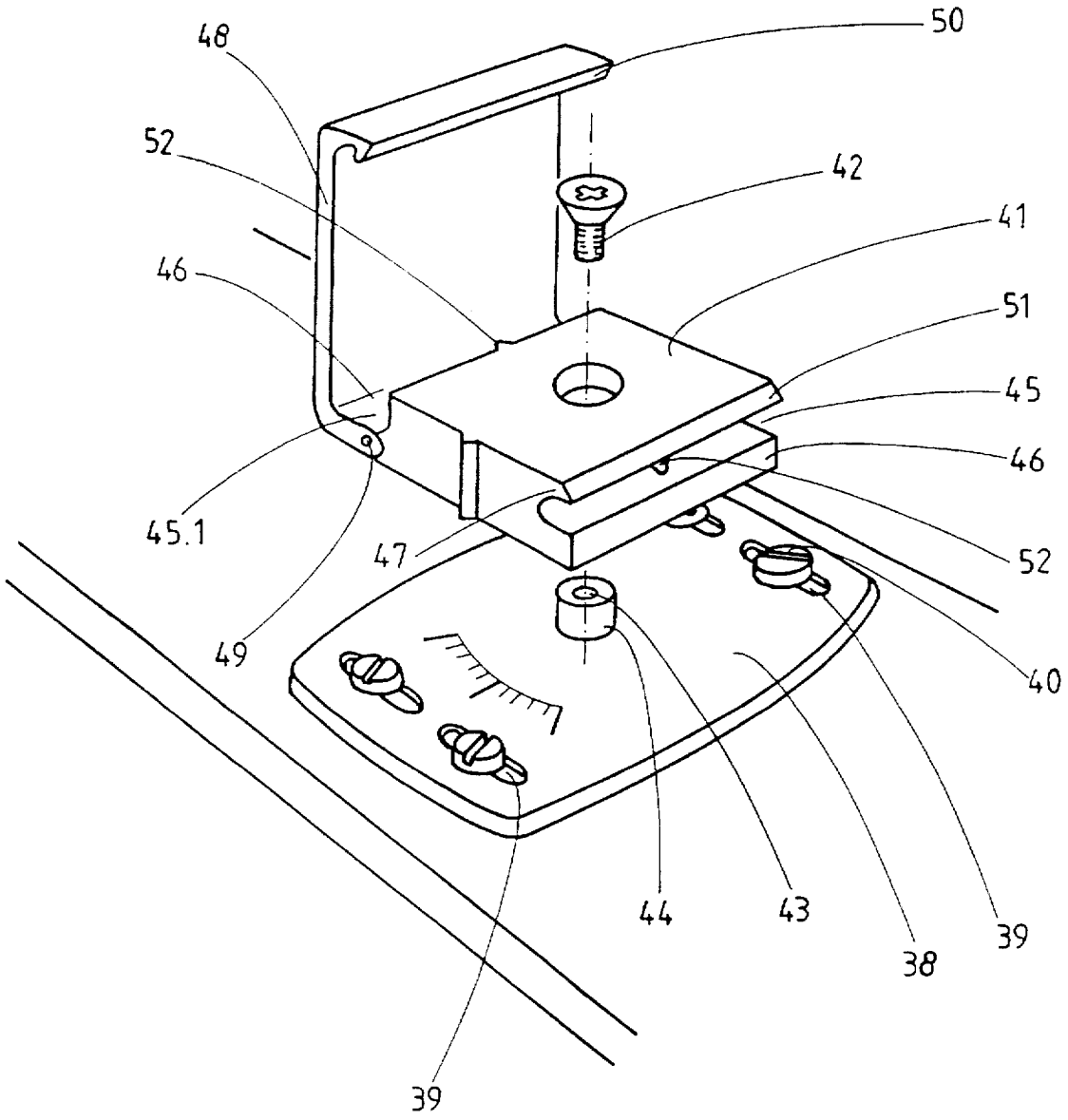
FIG. 8 shows an exploded view of a fastening part for fastening a binding on a snowboard.
Figure 9:
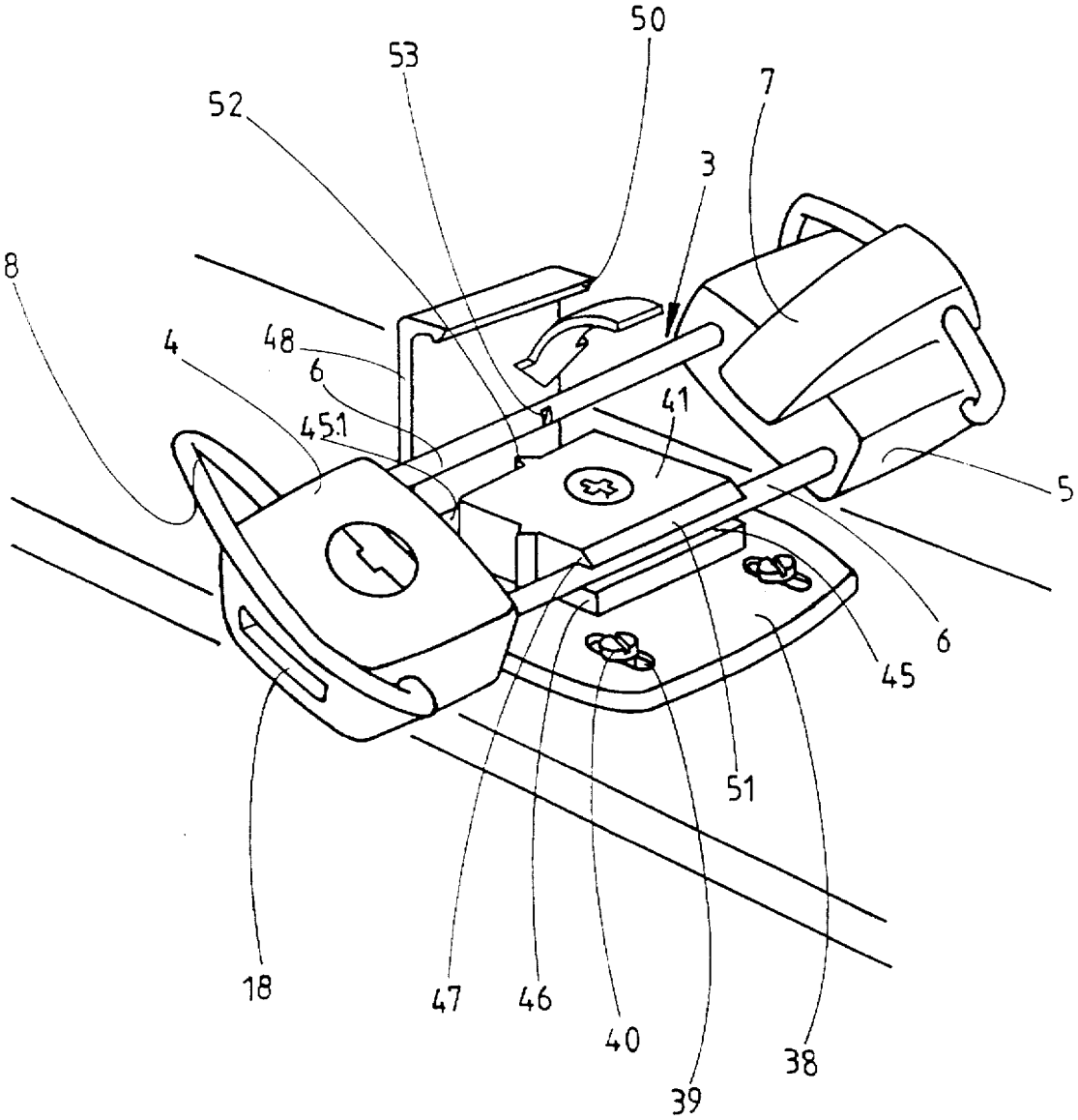
FIG. 9 shows this fastening part with a binding having a base frame immediately before fastening.
Figure 10:
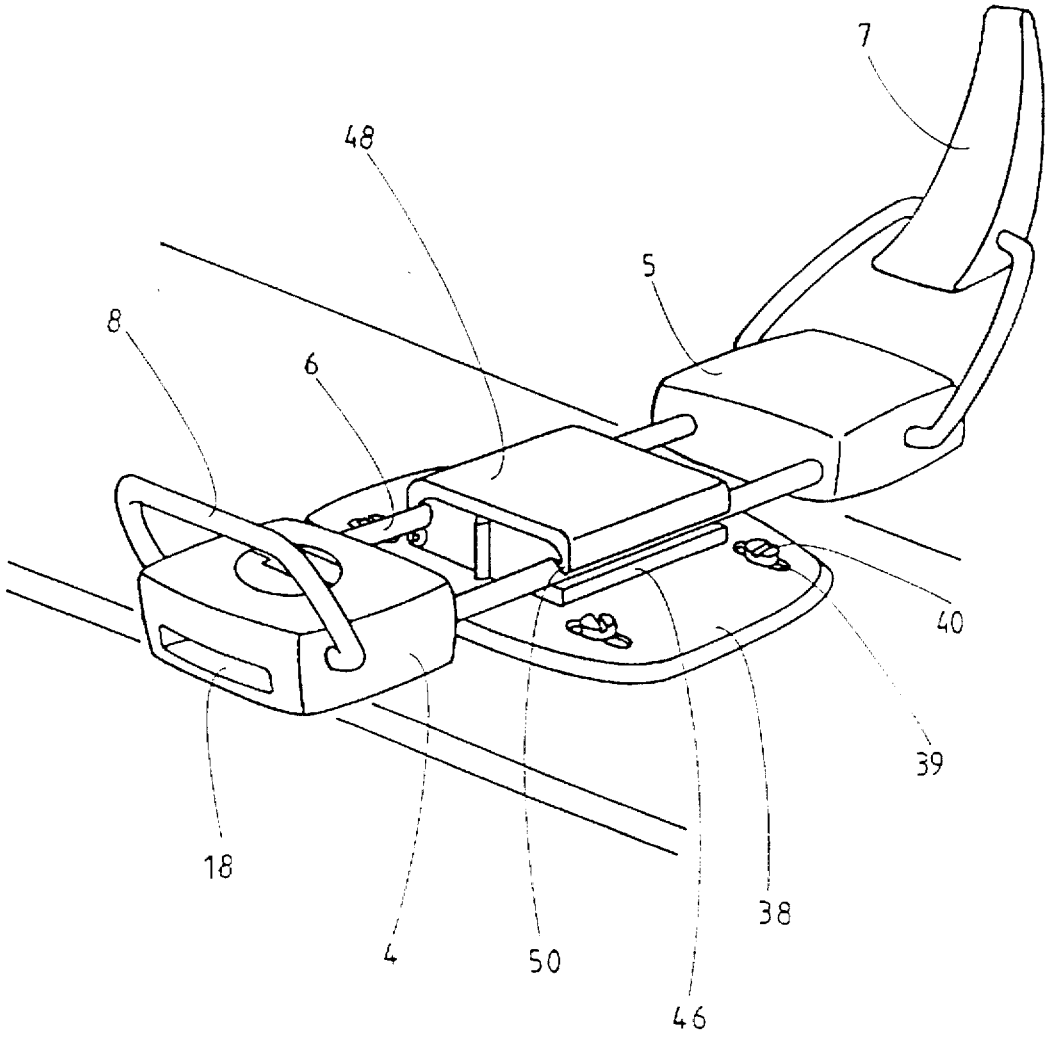
FIG. 10 shows this fastening part with a binding in the assembled state.

FIGS. 8 to 10 show a fastening part for a snowboard which can be used to fasten the base part with a base frame according to FIGS. 1 to 5 as well as the base part according to FIGS. 6 and 7. This fastening part has a base plate 38 which can be secured to the snowboard and is provided with transversely extending slots 39 through which the fastening screws 40 engage. These slots are provided so that the basic position of the hardware on the snowboard can be changed individually. A holding part 41 can be secured on the base plate by means of a fastening screw 42 which engages in a corresponding threaded hole 43 of a centering pin 44 on which the holder part 41 is arranged. At one longitudinal side extending parallel to the transverse direction of the snowboard, this holder part has a receptacle 45 constructed as a groove-like notch which is defined by a lower flange 46 and an upper flange 47, while a corresponding receptacle 45.1 is constructed at the opposite side where only the lower flange 46 is present and the upper flange 47 is omitted. At this side where the upper flange 47 is absent, a closing flap 48 covering the entire holder part 41 is swivelably supported at the lower flange 46 by means of a swivel pin 49 and can snap in under the flange 47 by means of a hook-like projection 50 in the closed state shown in FIG. 10. For this reason, the flange 47 has a bevel 51 at its outer end. When the closing flap 48 is closed, accompanied by deformation of the closing flap, the shoulder 50 slides along this bevel 51 until it snaps in behind the flange 47. Locking pegs 52 are formed within receptacles 45 and 45.1 so as to be integral with the holder part 41 and engage in corresponding recesses 53 in the legs 6 of the base frame as will be seen from FIG. 9. FIG. 9 shows the connection of a base part 3 with the holder part 41, wherein one leg 6 is first inserted into receptacle 45 and the other leg 6 is then inserted into receptacle 45.1 at the opposite side and the locking pegs 52 engage in the corresponding recesses 53. The closing flap 48 is then closed, as is shown in FIG. 10, so as to secure the leg 6 of the base frame 3 associated with receptacle 45.1.

In order that the soft binding according to FIGS. 6 and 7 can also be fastened on the snowboard by means of this fastening part, two legs 6.1 corresponding to the legs 6 of a binding with a base frame are provided in a corresponding recess 54 in the base plate 34 so that this binding can be fastened on the snowboard in the same manner as a binding with a base frame as was described with reference to FIGS. 8 to 10. Recesses 53 are likewise provided in the legs 6.1. The holder part 41 is received in the recess 54 of the base plate 34 in the assembled state.

While the foregoing description and drawings represent the preferred embodiments of the present invention, it will be obvious to those skilled in the art that various changes and modifications may be made therein without departing from the true spirit and scope of the present invention.

What is claimed is:

1. A binding for a touring ski and a snowboard, comprising:

a two part binding construction including a base part and a fastening part, said base part being provided with holders for a boot, said base part being employable for snowboard and touring ski use, said base part having a length less than approximately a snowboard width which allows this base part to be arranged on a snowboard substantially transversely thereto without projecting substantially beyond the snowboard, said fastening part taking the form of a lengthening piece connected to said base part, said fastening part being couplable in an articulated manner to a bearing part on a touring ski so as to be pivotable transversely to a longitudinal direction of the ski and forming a swivelable touring binding in combination with said base part, an insert enclosure being constructed at a front end of said base part of the binding to receive the lengthening piece in a positive engagement, and fastening means being provided for securing the lengthening piece in the insert enclosure.

2. The binding according to claim 1, wherein the lengthening piece associated with the insert enclosure has a free end which is slit in the longitudinal direction and has a conical recess in a region about the slit for a fastening screw having a centering cone which engages in the conical recess of the lengthening piece and wherein said fastening screw can be screwed into the insert enclosure so as to extend through the lengthening piece.

3. The binding according to claim 2, wherein the centering cone has a fold-up handle on its upper surface for operating the fastening screw.

4. The binding according to claim 1, wherein the lengthening piece is held in the insert enclosure so as to be displaceable and can be secured in a pushed in end position as well as in a pulled out end position which lengthens the base part to form a touring binding, and wherein an end of the lengthening piece projecting out of the insert enclosure has a transversely extending bore hole so that the lengthening piece can be swivelably mounted in a detachable manner on the bearing part arranged on the ski.

5. The binding according to claim 4, wherein the lengthening piece can be secured by means of a toe stirrup which is supported in a swivelable manner at a front sole support having the insert enclosure and can be locked into bore holes in the lengthening piece in a springing manner by ends which project into the insert enclosure and serve as bearing necks for the toe stirrup.

6. A binding for a touring ski and a snowboard, comprising:

a two part binding construction including a base part an a fastening part, said base part being provided with holders for a boot, said base part being employable for snowboard and touring ski use, said base part having a length less than approximately a snowboard width which allows this base part to be arranged on a snowboard substantially transversely thereto without projecting substantially beyond the snowboard, said fastening part taking the form of a lengthening piece connected to said base part, said fastening part being couplable in an articulated manner to a bearing part on a touring ski so as to be pivotable transversely to a longitudinal direction of the ski and forming a swivelable touring binding in combination with said base part, said base part having a base frame with two parallel legs which are connected with one another in a front region and a rear region of said base part by a front sole support and a rear sole support, respectively, the holders for the boot being arranged at the front sole support and the rear sole support, the front sole support having an insert enclosure for receiving the lengthening piece in a positive engagement.

7. A binding for a touring ski and a snowboard, comprising:

a two part binding construction including a base part an a fastening part, said base part being provided with holders for a boot, said base part being employable for snowboard and touring ski use, said base part having a length less than approximately a snowboard width which allows this base part to be arranged on a snowboard substantially transversely thereto without projecting substantially beyond the snowboard, said fastening part taking the form of a lengthening piece connected to said base part, said fastening part being couplable in an articulated manner to a bearing part on a touring ski so as to be pivotable transversely to a longitudinal direction of the ski and forming a swivelable touring binding in combination with said base part, said base part having a base plate carrying said holders, said base plate having a recess and two legs which are arranged at a distance from one another and penetrate the recess in a longitudinal direction of the base part, and an insert enclosure for receiving the lengthening piece in a positive engagement being constructed at a front end of the base part.

8. The binding according to claim 6, wherein a dovetail-shaped recess is formed at underside of the base part in a rear region of same and cooperates in a positive locking manner with a correspondingly adapted rail extending in the longitudinal direction of the ski so as to be stationary with respect to the ski in order to lock the base part in a downhill travel position.

9. A binding for a touring ski and a snowboard, comprising:

a two part binding construction including a base part and a first fastening part, said base part being provided with holders for a boot, said base part being employable for snowboard and touring ski use, said base part having a length less than approximately a snowboard width which allows this base part to be arranged on a snowboard substantially transversely thereto without projecting substantially beyond the snowboard, said first fastening part taking the form of a lengthening piece connected to said base part, said first fastening part being couplable in an articulated manner to a bearing part on a touring ski so as to be pivotable transversely to a longitudinal direction of the ski and forming a swivelable touring binding in combination with said base part, said binding further comprising a second fastening part for coupling the base part to the snowboard, said second fastening part having a holder part with receptacles constructed at two opposing sides of the holder part for receiving legs of the base part, one receptacle being constructed as a groove-shaped notch defined by a lower flange and an upper flange and the other receptacle being open towards an upper side and being defined only by a lower flange, and a closing flap being supported at the lower flange of said other receptacle so to be swivelable about a swivel pin provided parallel to a longitudinal axis of said other receptacle and can snap in under the upper flange of said one receptacle with a shoulder formed at a free lateral edge of the closing flap.

10. The binding according to claim 9, wherein the upper flange has a bevel which tapers outward at an upper side of a free edge of said upper flange.

11. The binding according to claim 9, wherein each receptacle has a longitudinal axis and a locking pin which is arranged at right angles to the longitudinal axis of the respective receptacle and engages in a corresponding recess of the respective leg of the base part in an assembled position of the binding.

* * * * *